US006721964B1

(12) United States Patent
Marshall

(10) Patent No.: US 6,721,964 B1
(45) Date of Patent: Apr. 20, 2004

(54) TOILET SEAT LIFTING AID

(76) Inventor: Randall B. Marshall, 16920 E. Carlson Dr., #316, Parker, CO (US) 80134

( * ) Notice: Subject to any disclaimer, the term of this patent is extended or adjusted under 35 U.S.C. 154(b) by 0 days.

(21) Appl. No.: 10/280,539

(22) Filed: Oct. 28, 2002

(51) Int. Cl.[7] ..... A47K 13/10
(52) U.S. Cl. ..... 4/246.1
(58) Field of Search ..... 4/246.1; D8/307; D23/311

(56) References Cited

U.S. PATENT DOCUMENTS

| | | | | | |
|---|---|---|---|---|---|
| 2,758,315 | A | * | 8/1956 | Hylton | 4/246.1 |
| 3,717,884 | A | | 2/1973 | Mantooth | 4/237 |
| D295,604 | S | * | 5/1988 | Purdy | D8/307 |
| 5,511,252 | A | * | 4/1996 | Kreemer | 4/246.1 |
| 5,727,258 | A | | 3/1998 | Derouin | 4/246.1 |
| 5,729,839 | A | | 3/1998 | Bigelow | 4/246.1 |
| D399,937 | S | * | 10/1998 | Earleywine | D23/311 |
| 5,963,992 | A | | 10/1999 | Bonner | 4/246.1 |
| D427,293 | S | * | 6/2000 | Yastrop | D8/307 |

* cited by examiner

*Primary Examiner*—Charles E. Phillips
(74) *Attorney, Agent, or Firm*—Sturm & Fix LLP

(57) ABSTRACT

A lifting aid (10) for raising and lowering a toilet seat (100) having a bottom surface (101) provided with a plurality of cushioning pads (102) wherein, the lifting aid (10) comprises a rigid generally rectangular lifting tab member (20) having an outer half (22) that is provided with an arcuate finger recess (24) and a plurality of raised ribs (23) to minimize the surface area contact between a user's fingers and the lifting tab member 20; and wherein, the inner half (25) of the lifting tab member (20) is provided with a layer of double sided adhesive for securing the lifting tab member (20) to the bottom (101) of a toilet seat.

5 Claims, 1 Drawing Sheet

TOILET SEAT LIFTING AID

CROSS REFERENCE TO RELATED APPLICATIONS

Not applicable.

STATEMENT REGARDING FEDERALLY SPONSORED RESEARCH OR DEVELOPMENT

This invention was the subject matter of Document Disclosure Program Registration No. 510,753, filed in the United States Patent and Trademark Office on May 1, 2002.

REFERENCE TO MICROFICHE APPENDIX

Not applicable.

BACKGROUND OF THE INVENTION

1. Field of the Invention

The present invention relates to the field of toilet seat lifting devices in general and in particular to a uniquely configured finned lifting tab.

2. Description of Related Art

As can be seen by reference to the following U.S. Pat. Nos. 3,717,884; 5,963,992; 5,729,239; and, 5,727,258, the prior art is replete with myriad and diverse handle constructions designed to be secured to the underside of a toilet seat.

While all of the aforementioned prior art constructions are more than adequate for the basic purpose and function for which they have been specifically designed, they are uniformly deficient with respect to their failure to provide a simple, efficient, and practical toilet seat lifting aid that is inexpensive to manufacture and has a unique contour that minimizes the physical contact between the user and the lifting aid while lowering the toilet seat.

As a consequence of the foregoing situation, there has existed a longstanding need among users of public toilets for a new and improved toilet seat lifting aid that is easy to install and contains structural features that facilitate both the lifting of the toilet seat and the lowering of the seat after use with minimum physical contact with the lifting aid, and the provision of such a construction is a stated objective of the present invention.

BRIEF SUMMARY OF THE INVENTION

Briefly stated, the toilet seat lifting aid that forms the basis of the present invention comprises in general a specially contoured lifting tab unit and a securing unit for mounting the lifting tab unit to the underside of a toilet seat.

As will be explained in greater detail further on in the specification, the lifting tab unit comprises a generally rectangular lifting tab member having an outer end provided with both an arcuate finger engaging recess and a plurality of raised ribs that minimize the surface area contact between a user's finger and the outer half of the lifting tab member when the toilet seat is lowered relative to the toilet bowl.

In addition, the inner half of the lifting tab member has a generally smooth top and bottom surface wherein, the securing unit is disposed on the top surface of the inner half of the lifting tab member and comprises a layer of double sided adhesive that attaches the inner half of the lifting tab member to the bottom of a conventional toilet seat.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
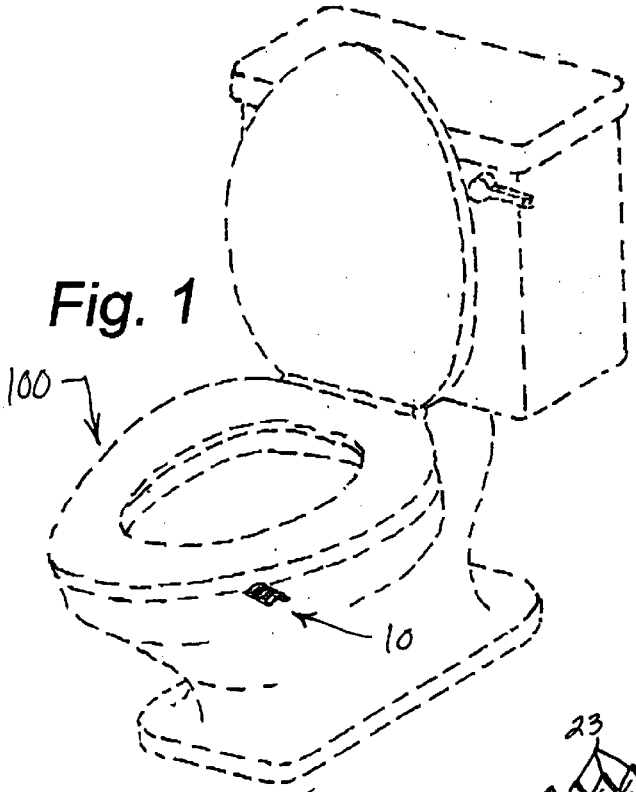
FIG. 1 is a perspective view of the toilet seat lifting aid installed on a toilet.
Figure 4:
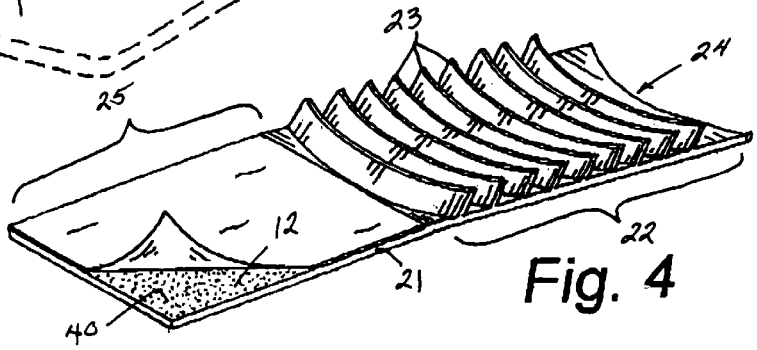
FIG. 4 is an isolated perspective view of the toilet seat lifting aid.

As can be seen by reference to the drawings, and in particularly to FIGS. 1 and 4, the toilet seat lifting aid that forms the basis of the present invention is designated generally by the reference number 10. The lifting aid 10 comprises in general a lifting tab unit 11 and a securing unit 12. These units will now be described in seriatim fashion.

As can best be seen by reference to FIG. 4, the lifting tab unit 11 comprises an elongated generally rigid tab member 20 preferably fabricated from hard plastic 21 or the like; wherein, the outer half 22 of the top surface of the tab member 20 is provided with a plurality of raised arcuate ribs 23 and terminates in a generally arcuate recess 24 dimensioned to receive one of a user's fingers.

In addition, the inner half 25 of the rigid tab member 20 has a generally rectangular flat smooth configuration on both its upper and lower surfaces; and, wherein, the outer half 22 of the tab member 20 has a flat bottom surface 22' and is angled slightly downwardly from the inner half 24 of the tab member 20 to accommodate the downward outer bevel found on a number of conventional toilet seats 100.

Figure 3:
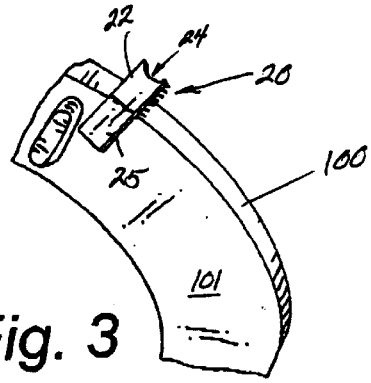
FIG. 3 is an isolated detail view of the lifting aid with the toilet seat in the raised position.
Figure 2:
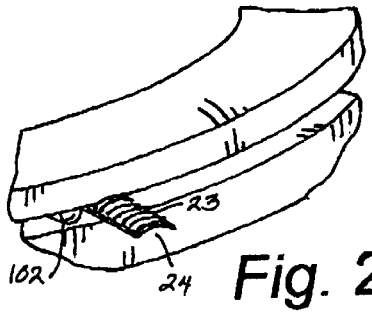
FIG. 2 is an isolated detail view of the lifting aid with the toilet seat in the lowered position.
Figure 5:
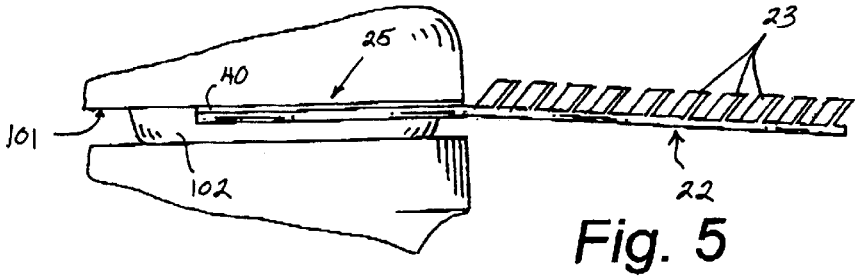
FIG. 5 is a side elevation view of the lifting aid installed on the bottom of a toilet seat.

As can best be see by reference to FIGS. 3 through 5, the securing unit 12 comprises a layer of double slick adhesive 40 that is provided on the top surface of the inner half 25 of the lifting tab member 20 wherein, the adhesive 40 secures the tab member 20 to the bottom surface 101 of a toilet seat 100 preferably adjacent to one of the toilet seat cushioning pads 102.

By now it should be appreciated that once the lifting aid 10 has been installed on the bottom 101 of a toilet seat 100, subsequent users of the toilet can easily lift the toilet seat 100 by inserting one of their fingers against the arcuate recess 24 with minimum contact with the bottom surface of the lifting aid 10. Then when the user wants to lower the seat, their finger is inserted in the opposite direction relative to the arcuate recess 24 and in this direction, the raised ribs 23 substantially minimize the surface area contact and potential contamination between the user's finger and the outer half 22 of the lifting tab member 20 for hygienic purposes.

It should also be noted that in the preferred embodiment of the invention, the lifting tab member 20 has the following dimensions: 2" in length and ¾" in width with a ⅛" thickness and raised ribs ¼" in height.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

What is claimed is:

1. A lifting aid for raising and lowering the bottom of a toilet seat wherein, the lifting aid comprises a generally rectangular rigid lifting tab member having an outer half and an inner half wherein, the outer half terminates in an arcuate finger engaging recess; and has a top surface provided with a plurality of raised ribs; and means for securing the inner half of the lifting tab member to the bottom of the toilet seat.

2. The lifting aid as in claim 1; wherein, both the outer and inner halves of the lifting tab member have a generally flat bottom surface.

3. The lifting aid as in claim 2; wherein, the inner half of the lifting tab member has a flat top surface.

4. The lifting aid as in claim 1; wherein, said plurality of raised ribs have a generally arcuate recess.

5. The lifting aid as in claim 4 wherein, said means for securing the inner half of the lifting tab member comprises a double sided adhesive.

* * * * *